US006681534B2

(12) United States Patent
David et al.

(10) Patent No.: US 6,681,534 B2
(45) Date of Patent: Jan. 27, 2004

(54) PYRAMID MAUSOLEUM AND COLUMBARIUM SYSTEM AND METHOD

(75) Inventors: Friedland David, Boca Raton, FL (US); Colette Golightly, Boca Raton, FL (US)

(73) Assignee: Pyramid Development Group LLC, New York, NY (US)

( * ) Notice: Subject to any disclaimer, the term of this patent is extended or adjusted under 35 U.S.C. 154(b) by 264 days.

(21) Appl. No.: 09/827,823

(22) Filed: Apr. 6, 2001

(65) Prior Publication Data

US 2002/0144471 A1 Oct. 10, 2002

(51) Int. Cl.[7] ..... E04H 13/00; E04H 9/00; A61G 17/00

(52) U.S. Cl. ..... 52/134; 52/136; 52/79.4; 27/1

(58) Field of Search ..... 52/128, 134, 135, 52/136, 39.3, 79.4; 27/1

(56) References Cited

U.S. PATENT DOCUMENTS

| | | | | | |
|---|---|---|---|---|---|
| 1,096,758 | A | * | 5/1914 | Rogers | 52/132 |
| 1,858,722 | A | | 5/1932 | Walker et al. | |
| 2,513,951 | A | * | 7/1950 | McClellan | 27/1 |
| 3,754,805 | A | * | 8/1973 | Pangburn et al. | 312/111 |
| 3,925,944 | A | * | 12/1975 | Pickel | 52/134 |
| 3,938,287 | A | * | 2/1976 | Gauchard | 52/134 |
| 3,978,627 | A | | 9/1976 | Booth | |
| 4,206,842 | A | | 6/1980 | Burridge, Jr. | |
| 4,207,684 | A | * | 6/1980 | Stice | 34/93 |
| 4,261,329 | A | * | 4/1981 | Walsh et al. | 126/569 |
| 4,688,359 | A | | 8/1987 | See | |
| 4,780,994 | A | * | 11/1988 | Chen | 52/30 |
| 4,781,174 | A | | 11/1988 | Gardner | |
| 4,881,714 | A | * | 11/1989 | Koppenberg | 249/60 |
| 4,928,447 | A | * | 5/1990 | Stoecklein | 52/136 |
| 4,989,382 | A | * | 2/1991 | Spronken | 52/252 |

(List continued on next page.)

FOREIGN PATENT DOCUMENTS

| | | | |
|---|---|---|---|
| GB | 5699 | * | 3/1894 |
| GB | 2 315 712 A | * | 11/1998 |

OTHER PUBLICATIONS http://www.milneconstruction.com.Milne%20innovations.htm, Milne Innovations, Copyright © Milne Construction Co. (Revised: Oct. 22, 2000).

http://www.celebrationgardens.com/business/turnkey/index.html, and http://www.celebrationgardens.com/business/turnkey/page1.html through http://www.celebrationgardens.com/business/turnkey/page8.html, The Business: Celebration Gardens—Architecutral Elements, 9 pages (Copyright © 1999 Celebration Gardens).

(List continued on next page.)

*Primary Examiner*—Carl D. Friedman
*Assistant Examiner*—Kevin McDermott
(74) *Attorney, Agent, or Firm*—Pennie & Edmonds LLP

(57) ABSTRACT

A system and method for memorializing life is disclosed. In one embodiment of the invention, a method includes storing human or other animal remains in a structure, such as an outer pyramid-shaped structure, wherein the remains are stored in vaults and urns. The embodiment also may include other structures, such as one or more inner pyramid-shaped structures housed by the outer pyramid-shaped structure. The embodiment also preferably includes computer resources employable to display holographic images and memorial records concerning the deceased, such as video and photographic images, medical records, such as DNA, as well as artifacts and personal belongings. The invention may also include a structure positioned underneath the outer pyramid-shaped structure, housing a world religions museum offering various displays, exhibitions, and services.

17 Claims, 10 Drawing Sheets

U.S. PATENT DOCUMENTS

| | | | | | |
|---|---|---|---|---|---|
| 5,622,014 | A | * | 4/1997 | Weiss | 52/105 |
| 5,765,269 | A | * | 6/1998 | Zarth | 27/26 |
| 5,881,505 | A | * | 3/1999 | Larkin, III et al. | 52/136 |
| 5,894,699 | A | * | 4/1999 | Fulton et al. | 52/132 |
| 5,918,276 | A | * | 6/1999 | Grindle et al. | 73/170.11 |
| 5,987,720 | A | | 11/1999 | Yamamoto | |
| 6,052,954 | A | | 4/2000 | Dudek et al. | |
| 6,161,268 | A | * | 12/2000 | Joseph | 27/35 |
| 6,218,787 | B1 | * | 4/2001 | Murcko et al. | 315/194 |
| 6,474,025 | B1 | * | 11/2002 | Faiks et al. | 52/36.1 |
| 6,484,457 | B1 | * | 11/2002 | Dudek et al. | 52/128 |
| 6,491,268 | B1 | * | 12/2002 | Channer et al. | 248/176.1 |

OTHER PUBLICATIONS http://www.celebrationgardens.com/about/index.html, About Celebration Gardens, 2 pages (Copyright © 1999).

http://www.celebrationgardens.com/gallery/photos/page4.html, The Gallery: Photographic Tour—Courtyard Garden, 2 pages (Copyright © 1999 Celebration Gardens).

http://www.celebrationgardens.com/business/columbarium.html, The Business: Columbarium Wall vs Celebration Garden, 2 pages (Copyright © 1999 Celebration Gardens).

http://www.celebrationgardens.com/business/21century.htm, The Business: 21st Century Trends in Death Care, 2 pages (Copyright © 1999 Celebration Gardens).

http://www.celebrationgardens.com/business/atmosphere.html, The Business: Celebration Gardens—The Atmosphere, 2 pages (Copyright © 1999 Celebration Gardens).

http://www.celebrationgardens.com/business/advantages.html, The Business: The Advantages of a Celebration Garden, 2 pages (Copyright ©1999 Celebration Gardens).

Andy Beckett, Raising the dead, Oct. 14, 1998, 3 pages (Copyright © Gaurdian Newspapers Limited, The Guardian (London)).

Greg Dawson, Oct. 16, 1994 A Column Of Criticism? Not In My Back Yard?, 2 pages, Orlando Sentinel Tirbune (Copyright 1994 Sentinel Communications Co. The Orlando Sentinel).

Steve Orlando, Nov. 16, 1994, Pyramid firm still seeks site, 2 pages, The Tampa Tirbune (Copyright 1994 The Tribune Co.).

Jeremy Pearce, Nov. 7, 1997, 3 pages, Nations's urban cemeteies quickly run out of space: Cities look to high–rise mausoleums (Copyright 1997 The Detroit News, Inc.).

http://seattletimes.nwsource.com/news/lifestyles/htm198, ceme_021699.html, seattletimes.com: New Life for a Hollywood cemetery, 3 pages, Jeff Wilson, The Associated Press.

Christopher Woodward, Jun. 3, 1998, Keeping a roof over our dead, The Times (Copyright 1998 Times Newspapers Limited).

The Associated Press, Sep. 25, 1994, Neighbors Don't Want To Live In Pyramid Shadow (Copyright 1994 Sun–Sentinel Company, Sun–Sentinel (For Lauderdale)).

* cited by examiner

PYRAMID MAUSOLEUM AND COLUMBARIUM SYSTEM AND METHOD

TECHNICAL FIELD

The invention relates to a system and method for memorializing life. More particularly, the invention relates to a system and method for memorializing the lives, and storing the remains of the memorialized humans and/or animals.

BACKGROUND OF THE INVENTION

Systems and methods for memorializing the deceased exist in the art. And it is commonly known that these systems and methods include structures for housing bodies or cremated remains of the deceased. As space in urban cemeteries is becoming scarce due to increases in the population, and the use of vacant land for commercial or residential concerns, it is predicted that the need for building large, centralized mausoleums and cremation storage facilities will also increase.

One potential structure that may be used to accommodate such need is the pyramid, which was used in ancient Egypt to entomb and memorialize mummified remains of pharaohs. Those pyramids also contained epitaphs and memorabilia that identified and honored the pharaohs.

Today, the pyramid continues to fascinate and intrigue many due to its history and unique shape, and there is also a substantial number of people throughout the world who believe that pyramids and their shape have certain spiritual power to influence the lives of others, and over the unknown. Indeed, there is tremendous interest in the spiritual allure of pyramid structures and the pyramid shape itself. Some systems for storing human remains have borrowed from the Egyptian tradition by providing pyramid-shaped outer housings for the remains. For example, U.S. Pat. No. 6,052,954 to Dudek et al. discloses an outer pyramid-shaped burial structure for securely housing human remains.

Other systems that may contribute to alleviating the problem caused by lack of burial space, and the way humans deal with death care, employ current technology to provide more services and options for those memorializing the deceased. For example, the Church of Latter Day Saints (Mormons) has established systems to preserve, display and enable access to written or documentary genealogical information. Other systems provide services where the life achievements of the deceased are recorded on a computer. For example, the "Hollywood Forever" cemetery in California has added video kiosks where a computer-activated television can play videos concerning the deceased. Further, the Celebration Gardens company states that it plans to offer DVD biographies, music, and a limited form of DNA information along with the cremated remains of the deceased at its memorialization sites.

But these systems and methods have not offered a comprehensive array of technologies, exhibitions, and services and/or included buildings uniquely employing pyramid or other shapes to memorialize lives, and to attract both customers and casual visitors or tourists to the site. In fact, market research evidences a death care market that presently is approximately 85% underpenetrated, and shows that there has yet to be a method or system that truly takes advantage of this tremendous business opportunity.

Additionally, it is well known that the death care industry has had difficulty in marketing its products and services to younger age groups.

Therefore, there is a need in the art for a system and method that overcomes the drawbacks of the systems and methods existing in the art.

There is also a need in the art for an improved system and method for storing and memorializing the deceased, and for memorializing the living.

There is also a need for an improved system and method for promoting positive and beneficial emotional feelings and attitudes of its customers and visitors toward memorializing the deceased.

There is also a need for an improved system and method for providing comprehensive records concerning the deceased and the living that is easily accessible.

There is also a need for a system and method that combines religion, science, and entertainment to provide death care services at a single location that can attract and accommodate many visitors.

There is also a need for an improved structure for storing and memorializing the deceased, and for memorializing the living.

There is also a need for a system and method that employs pyramid-shaped structures enclosed by an outer pyramid-shaped structure to memorialize the deceased and/or living.

There is also a need for a system and method that combines modern technology for storing and displaying information and memorabilia concerning the deceased and/or living with the emotional and psychological benefits derived from pyramid-shaped structures in memorializing the deceased and/or living.

SUMMARY OF THE INVENTION

The present invention is a novel method and system for storing human and/or animal remains, and memorializing life through various commercial, technical, religious, scientific, artistic, and structural features. The unique combination of features of the present invention as described herein will enable the marketing and sale of death care, and death care products and services to previously untapped and largely ignored markets, particularly to people of younger age groups. Living people will have the opportunity to provide and store memorial records as described herein. Thus, people and their friends and family will be able to build a library of memorial records that may be employed before and after their deaths, both remotely and at the site where their remains are or will be buried.

Moreover, by employing a mass central structural complex that uniquely combines a diverse and broad array of religion, science and art, the present invention will not only provide a unique and beneficial psychological experience for the clientele, but will serve as a tourist attraction.

In one embodiment of the present invention, a method for memorializing life includes storing human or other animal remains in vaults and urns, wherein one or more of the urns are placed in storage niches that secure and display holographic images, and providing computer resources that enable the retrieval of memorial records concerning specific individuals.

The holographic images, may be embedded in transparent material covering the storage niches. The holographic image may be associated with the urn positioned in the storage niche behind the holographic image. The computer resources may enable the holographic images to be activated or lit, such that they may be viewed or displayed.

The memorial records may include displays of video and photographic matters, medical records, DNA, hair samples, and/or artifacts and personal belongings concerning specific individuals or animals.

Advantageously, the memorial records may be remotely loaded onto and retrieved from the computer resources from a public network.

The present invention may also provide displays and exhibitions concerning religions throughout the world.

The present invention may utilize solar energy to cremate human remains.

The present invention may provide religious structures such as a cathedral or temple positioned at the top of the housing structure itself.

The computer resources may enable projection of images associated with a deceased individual or animal, such as videos and photographs of the deceased individual or animal.

The computer resources may be employed to display memorialization records and other images on the Internet. The other images may include funerals or memorial services that are viewable on the Internet in real-time. The memorialization records may also be viewable on the Internet in real time.

The present invention may further include providing concessions, restaurants, and dining and entertainment areas.

In another embodiment, the features of the present invention are employed in a uniquely-shaped building for storing human and animal remains, which includes an outer pyramid-shaped structure, one or more inner pyramid-shaped structures housed within the outer pyramid-shaped structure, and vaults and urns for storing the human remains, wherein the urns are positioned in storage niches housed within the outer pyramid-shaped structure or inner-pyramid structure.

The building may actually have multiple inner pyramid-shaped constructions, wherein one or more of the multiple inner pyramid-shaped structures intersect one or more of the multiple inner pyramid-shaped structures.

The building may also include a structure positioned beneath the outer pyramid-shaped structure for providing information, exhibitions, and services concerning different world religions.

The building may include additional vaults and storage niches positioned or housed within a structure beneath the outer pyramid-shaped structure.

The building may also include computer resources accessible from within the structure, enabling the retrieval of memorial records concerning specific individuals or animals. These computer resources may be employable to control lighting within the outer and inner pyramid-shaped structures.

The building may include religious structures positioned at the top of the outer pyramid-shaped structure. The religious structures may include a cathedral or temple.

The vaults may be positioned on external faces of the outer pyramid-shaped structure.

The building may include solar panels positioned on an exterior surface of the outer pyramid-shaped structure to create power for use by the building.

The building may include solar panels positioned in proximity to the building to create power for use by the computer resources.

The storage niches may be positioned behind the surfaces of inside walls of the inner pyramid-shaped structures. Holographic images may be embedded in transparent material covering the storage niches. Each holographic image embedded in the transparent material may be associated with the urn positioned in the storage niche behind the transparent material. The building may also include computer resources that enable specific storage niches to be activated or lit.

In another embodiment, a method for memorializing life includes storing human or animal remains in vaults and urns, storing DNA by refrigeration or freezing to preserve the DNA, and providing computer resources that enable the retrieval of memorial records concerning specific individuals. The refrigeration or freezing may be powered by solar radiation. The images of the DNA may be stored on the computer resources. The DNA may be frozen or refrigerated in a structure containing liquid nitrogen.

BRIEF DESCRIPTION OF THE DRAWINGS

The detailed description is better understood in conjunction with the accompanying drawings, in which like reference characters represent like elements, as follows:

FIG. 3(*b*) is top view of an example of a configuration of elements of the present invention;

FIG. 3(*c*) is another top view of an example of a configuration of elements of the present invention;

FIG. 3(*d*) is an exploded view of the example of a configuration of elements of the present invention shown in FIG. 3(*c*);

FIG. 3(*e*) is another top view of an example of a configuration of elements of the present invention;

FIG. 3(*f*) is another top view of an example of a configuration of elements of the present invention;

FIG. 6(*b*) is a perspective view of interior walls of an inner pyramid-shaped structure in accordance with the present invention.

DETAILED DESCRIPTION OF THE PREFERRED EMBODIMENT

Figure 1:
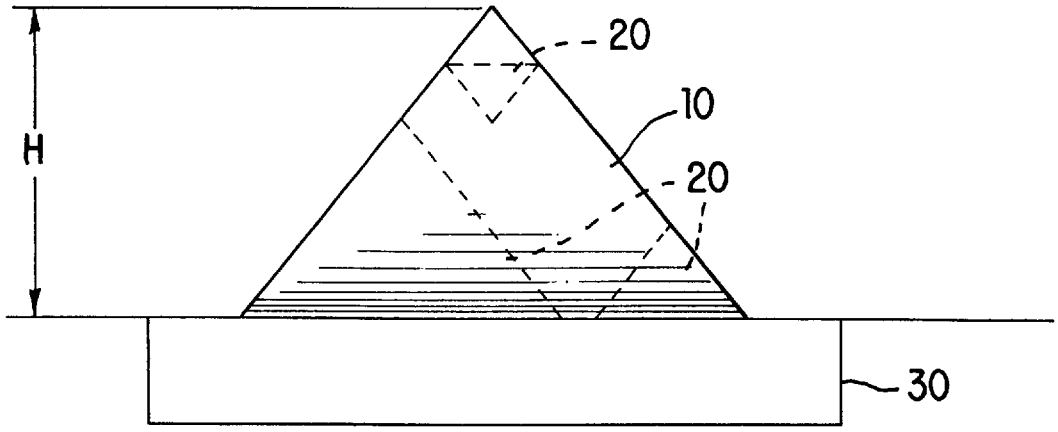
FIG. 1 is a diagram of a front view of an embodiment of the structure for memorializing human life in accordance with the present invention.

FIG. 1 is a diagram of one embodiment of a structure or building for memorializing human life. This embodiment includes outer pyramid-shaped structure 10, one or more inner pyramid-shaped constructions 20 housed within the outer pyramid-shaped structure 10, and a structure 30, preferably a housing with a world religions museum enclosed, spaced underneath the outer pyramid-shaped structure.

Note that although the pyramid-shape is employed in the following embodiments, any other suitable shapes of structures and/or buildings may be alternatively or additionally employed uniquely as described in the system and method of the present invention.

If desired, the present invention may have a body of water 32 surrounding it. Preferably, the body of water 32 will have a level (i.e. top surface) that has the same altitude as the bottom of outer pyramid-shaped structure 10, and thus the top of structure 30. Structure 30, and possibly outer pyramid-shaped structure 10, will be secured within body of water 32 by means known in the art. The relative positioning of outer pyramid-shaped structure 10, structure 30, and body of water 32 will create the appearance of having outer pyramid-shaped structure 10 "float" on the water, or have outer pyramid-shaped structure 10 seem suspended between the sky and water. Also, boats may be employed to transport visitors across body of water 32 to the structures or buildings of the present invention. In one implementation, outer pyramid-shaped structure 10 may include a portion near its portion that is raised above body of water 32 to allow a boat to float inside this portion into the interior of outer pyramid-shaped structure 32.

Additionally or alternatively, the present invention may include ampitheatre 34, a construction configured to seat visitors around a location to position performers, such as a stage or other platform. Ampitheatre 34 may be configured with a circular or partially-circular housing for and including a set of seats, preferably configured such as in a stadium, surrounding the location to position the performers. The ampitheatre may be positioned in proximity to outer pyramid-shaped structure 10, structure 30, and/or, if included, body of water 32. The ampitheatre may be employed for concerts, sound, light, and water shows, such as the projection of dramatic theatrical displays onto sprayed water as known in the art.

Also, if desired, the present invention may include one or more religious exhibits, gardens, and/or other features positioned outside the perimeter of the structures or buildings of the present invention to contribute to the religious theme of the present invention. Thus, for example, a model of the mythological "Paradisiacal Gardens" or the "Celestial Gardens" of science may be positioned outside of the structures of buildings of the present invention.

Figure 2:
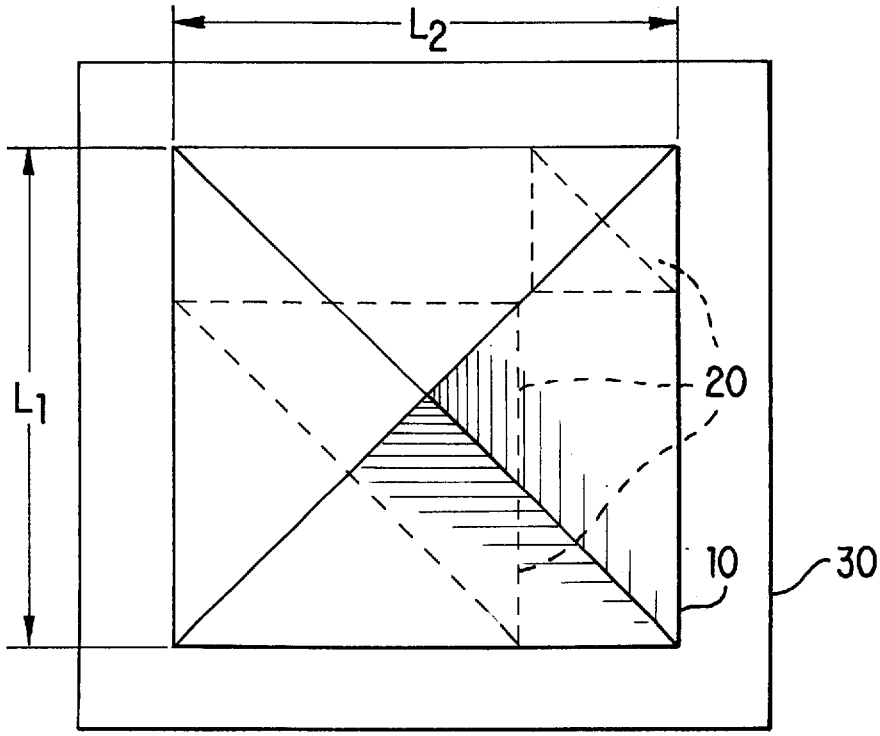
FIG. 2 is a top view of an embodiment of the structure for memorializing human life in accordance with the present invention.
Figure 3A:
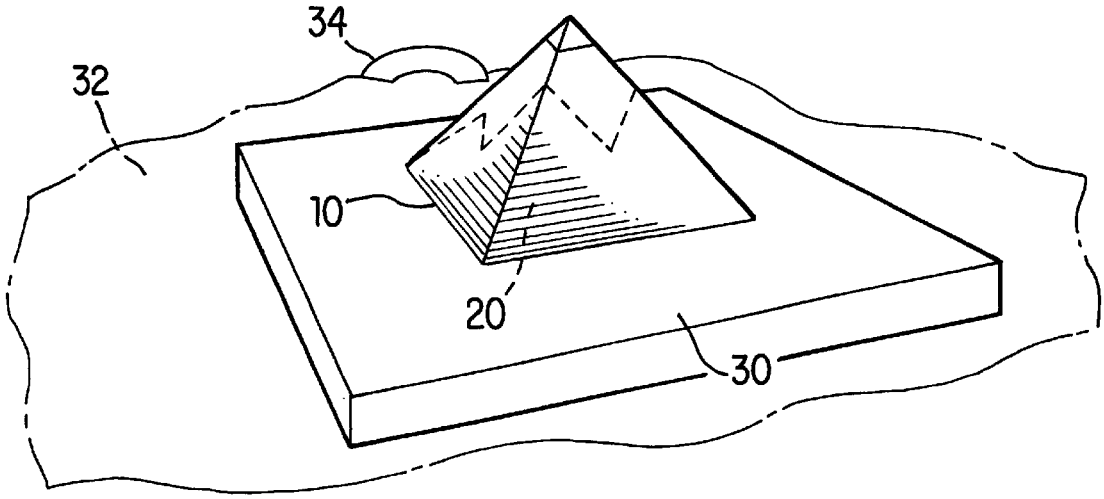
FIG. 3(*a*) is a perspective view of an example of a configuration of elements of the present invention.
Figure 3C:
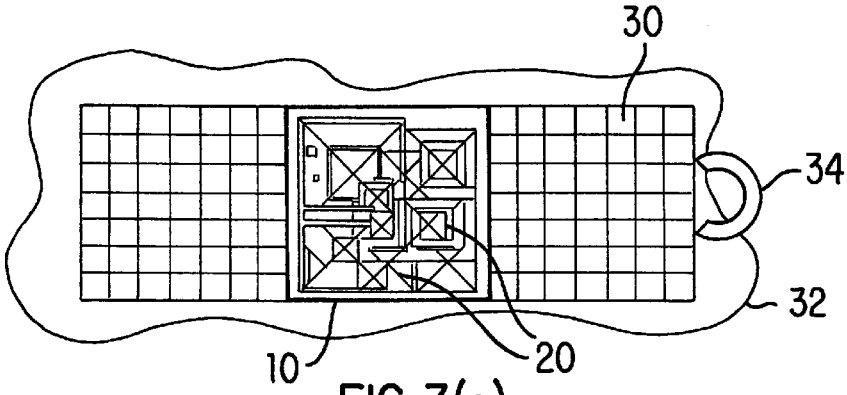
Figure 3B:
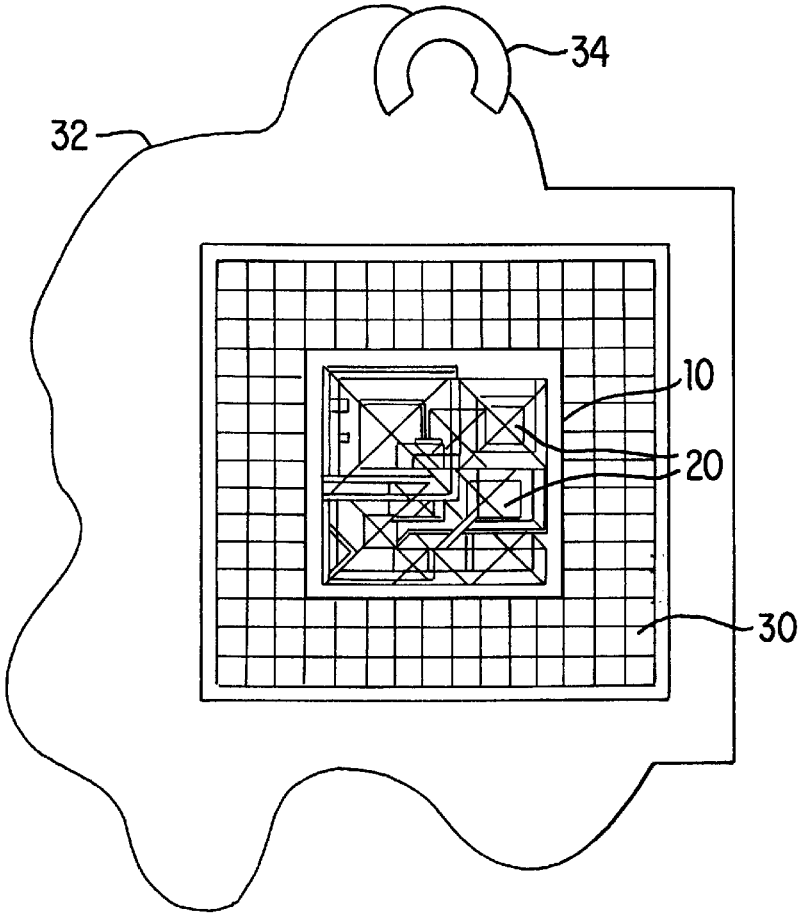
Figure 3D:
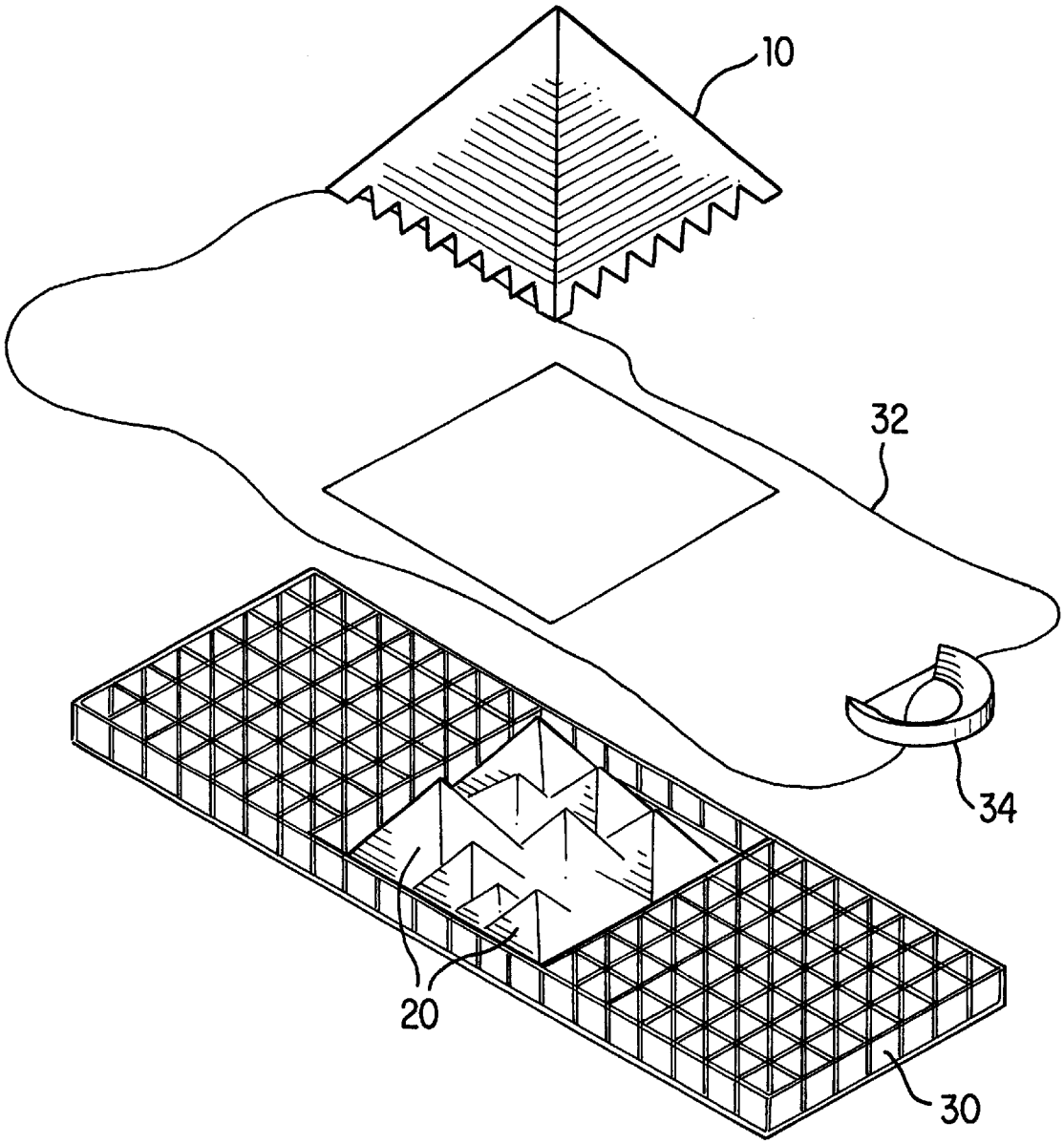
Figure 3E:
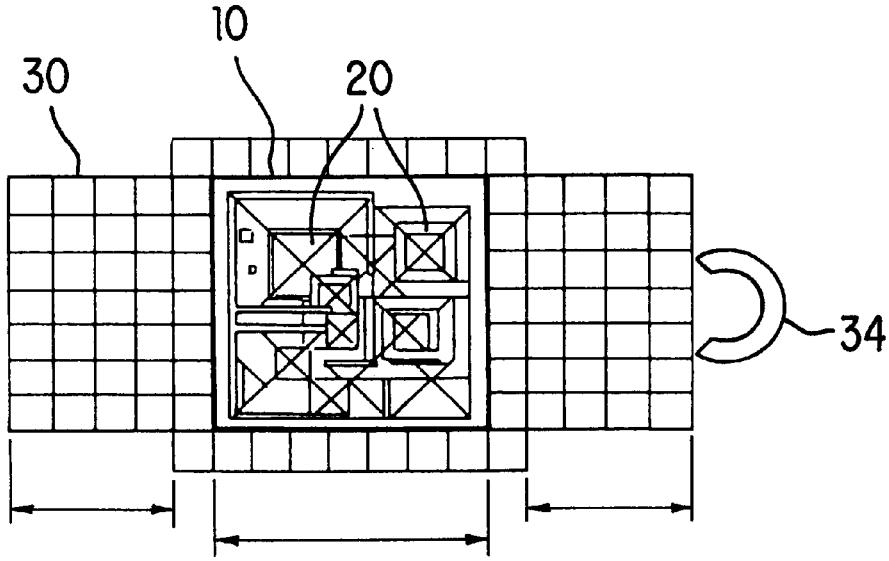
Figure 3F:
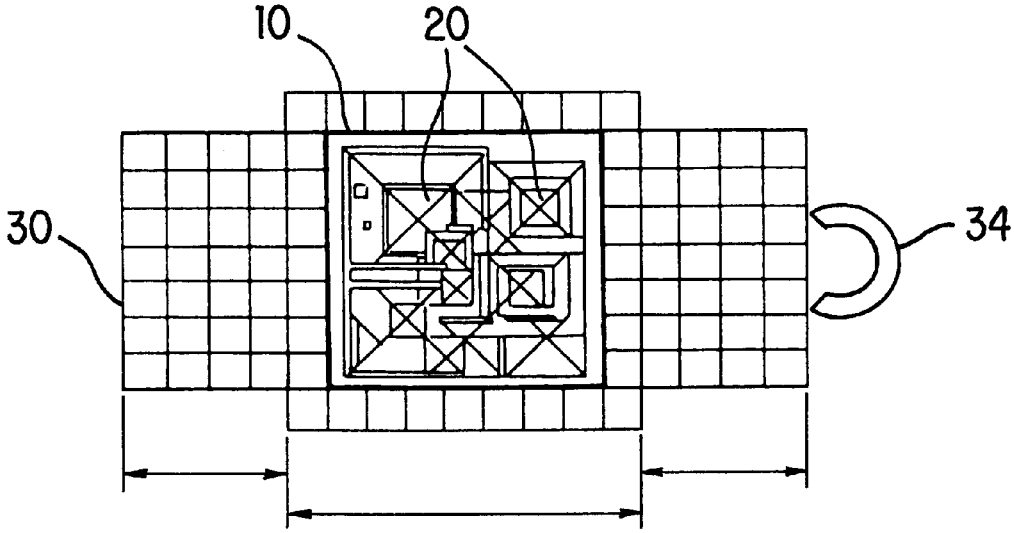

Referring to FIG. 2 along with FIG. 1, the outer pyramid-shaped structure 10 is preferably a four-sided structure having a square base such that length L1 is equal to length L2. However, pyramid-shaped structure 10 may be constructed with three sides or more than four sides, and the sides may have different lengths if desired. Preferably, outer pyramid-shaped structure 10 is constructed according to the mathematical formula said to have been used by the Egyptians for the construction of the Pyramid at Gizeh. This mathematical formula is called the Golden PHI. According to the Golden PHI, the length of any of four equal sides of the pyramid base is multiplied by 0.636009825 to obtain the pyramid height. In a preferred implementation of this formula, lengths L1 and L2 of outer pyramid-shaped structure 10 are 777 feet long, and height H is 494.18 feet, or 0.636009825 times the length (777 feet) of a side of the pyramid base. Use and promotion of the Golden PHI in the present invention may encourage visitation by those who are intrigued by the ancient Egyptian traditions for memorialization of the deceased, as well as the mythology surrounding these traditions, such as "pyramid power."

Examples of the layout of the components of the present invention described above are shown in FIGS. 3(*a*)–3(*f*), wherein the examples shown in FIGS. 3(*a*)–3(*d*) show embodiments of the present invention that include body of water 32.

The outer pyramid-shaped structure 10 and/or one or more of the inner pyramid-shaped structures 20 may be constructed such that the floor and wall elements of the structures interact to reduce the stresses to certain portions of the structures. For example, the walls of the structures may be supported by steel-bar reinforced concrete or double T-beams, such as known in the art, secured to the floor of the structures. In a preferred embodiment, the floor system may be constructed with precast double T-units. The structures may also be built using concrete, steel, metal alloys, sheet glass, glass blocks, marble and/or granite. The exterior surface of outer pyramid-shaped structure 10 preferably has a glass exterior so that its interior can be lit by sunlight during the day, and titanium and steel structure. The exterior surfaces of inner pyramid-shaped structures 20 preferably are constructed of different materials, such that one or more inner pyramid-shaped structures 20 are constructed with stone in a stepped configuration, one or more with glass, and/or one or more with metal. Alternatively, these structures may be constructed of other materials known in the art, such as those that will extend the life expectancy of the structures or for other purposes as desired.

Outer and inner pyramid-shaped structures 10 and 20 respectively, and world religions museum 30, may be constructed to be capable of accommodating precast vaults. Thus, some portions of the building of the present invention may be constructed to enable later reception of vaults, which have been described above. This implementation may employ a precast stacked "egg-crate" scheme, as known in the art, where the vaults are stacked to create a structure.

Vaults 40 may be included on the exterior faces (see FIG. 4) and/or within pyramid-shaped structure 10 and/or inner pyramid-shaped structures 20. The vaults preferably store one or more human or animal remains, or other material as desired. Thus, the vaults may be constructed to house one or more coffins or urns or other receptacles that store human or animal remains. In another implementation of this embodiment, the receptacles are built into the floor of some or all of the vaults. The receptacles, preferably constructed of aluminum, fiberglass, or other suitable synthetic material, may be sealed with a lid, preferably made of a metal, plastic or concrete. Alternatively or in addition, the vaults may be constructed with one or more crypts to store human remains. The crypts may each be sealed with metal, concrete, or other suitable material. Use of crypts advantageously eliminates the necessity of purchasing individual receptacles to store the deceased, although crypts may be configured to house any size or configured receptacle, if desired. Where crypts are used without receptacles, the crypts may be lined with synthetic or other material to support the remains. Advantageously, the vaults will be configured so that their contents, such as the receptacles or crypts, may be viewed by visitors. The present invention may also permit arrangements commonly referred to as condominiums, or time sharing. Thus, the vaults may be shared, leased, or exchanged, enabling family planning for family burials, or relocation of receptacles without disinterment. Also, the vaults will preferably employ security mechanisms, such as aluminum doors with private locks, or other electronic or mechanical security devices. Alternatively, some or all of the vaults may be permanently sealed. Yet another alternative is for the vaults to be open to the public.

Figure 4:
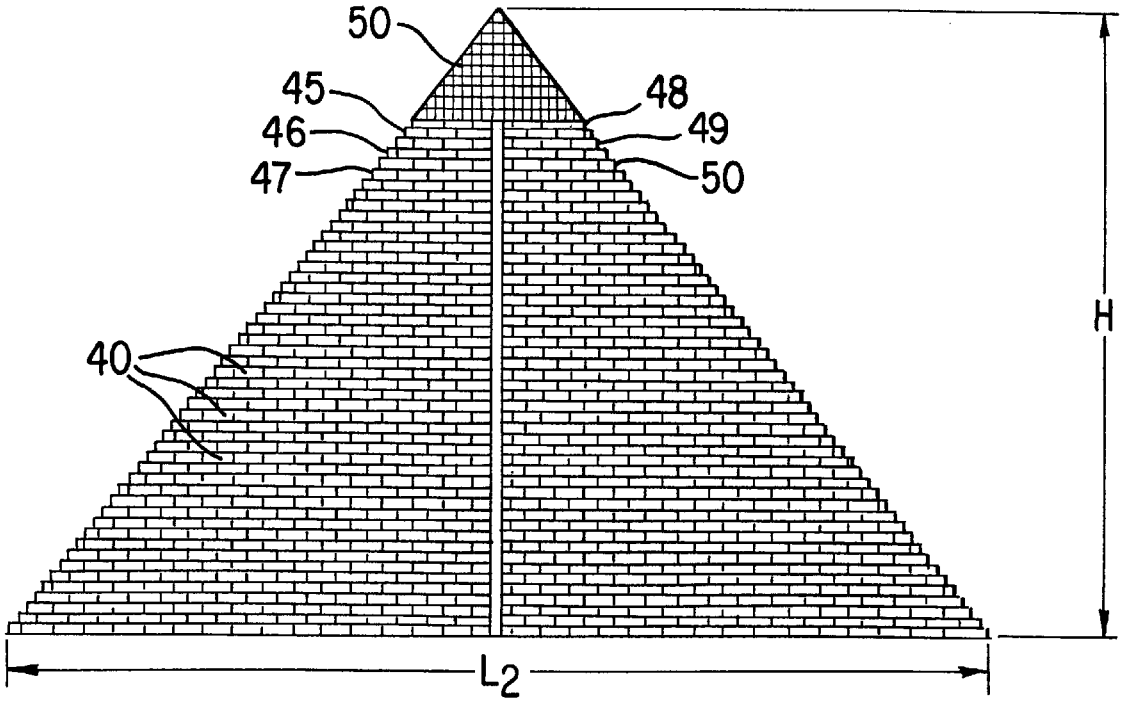
FIG. 4 is a front view of an embodiment of the outer pyramid-shaped structure in accordance with the present invention.

Preferably, as shown in FIG. 4, religious structures 50, such as one or more cathedrals, churches, temples or other active religious sites for memorials, will be included with the present invention and positioned at or near the top of the pyramid. But the religious structures may be positioned elsewhere on, or within outer pyramid-shaped structure 10. The religious structures may be constructed of steel, glass, or crystal, or other transparent material or a combination of these, or other suitable construction materials known in the art. Preferably, the religious structures are enclosed in glass. Also, a funeral parlor is preferably included with the present invention and positioned such that it is easily accessible from the religious structure. In one embodiment of the present invention, hydraulic or other lifts or elevators are employed to elevate coffins and other receptacles directly into the cathedral, and/or to project memorials or visual displays of memorials. Employment of this embodiment will achieve a desired appearance of coffins or urns or other memorials ascending or descending into the body of the pyramid for transport to a vault or other burial mechanism.

Figure 5:
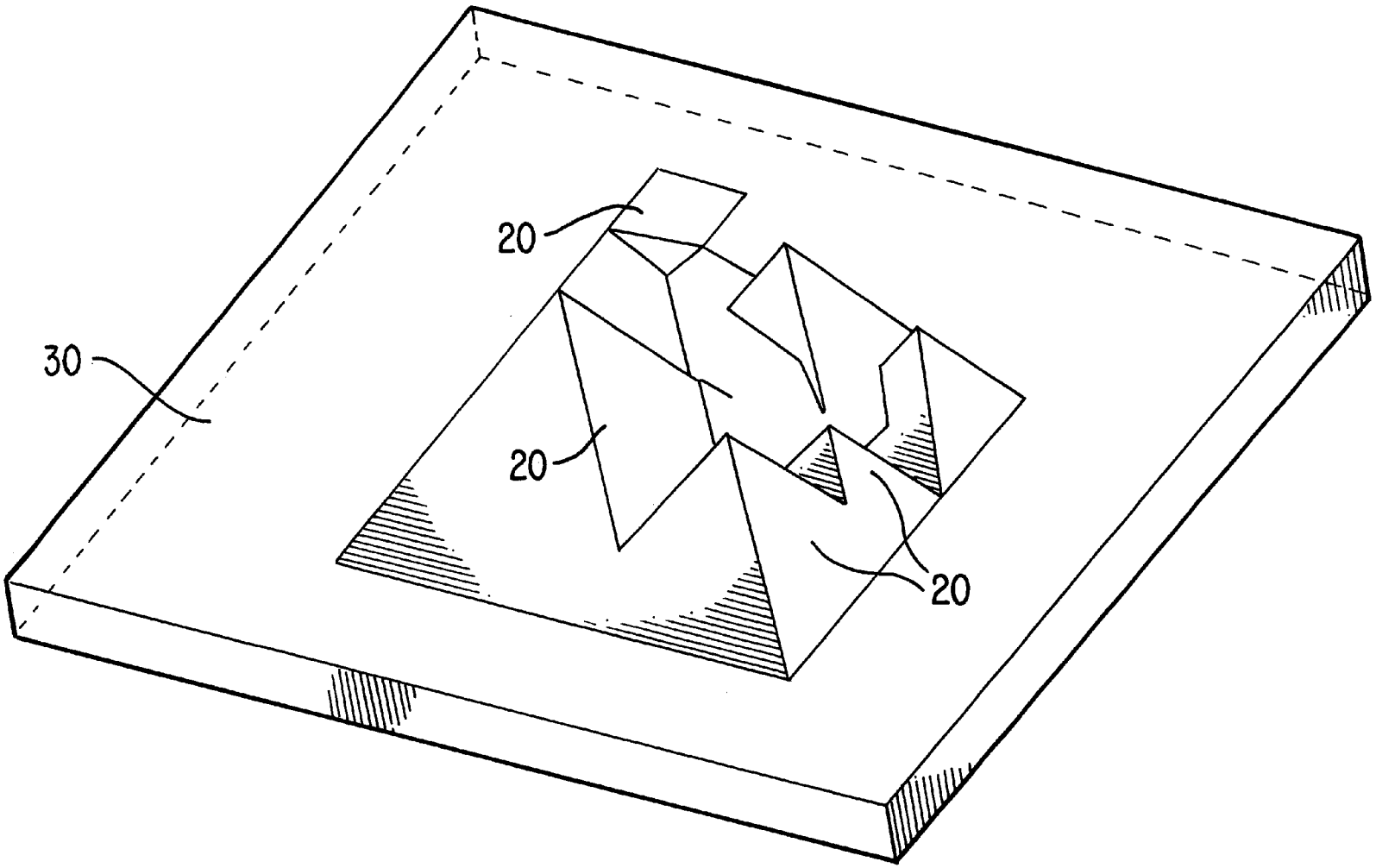
FIG. 5 is a perspective view of an example of a configuration of multiple inner pyramid-shaped structures in accordance with the present invention.

Preferably, one or more inner pyramid-shaped structures 20 are housed within outer pyramid-shaped structure 10. As shown in FIG. 5, as well as FIGS. 3(*a*)–3(*f*), inner pyramid-shaped structures 20 may be of different sizes, may overlap, and be oriented as desired, such as upside-down. These structures may be used for various purposes, such as for meditation or religious observances, and/or to display information, such as information concerning a specific religion, or information memorializing the deceased or living.

Figure 6A:
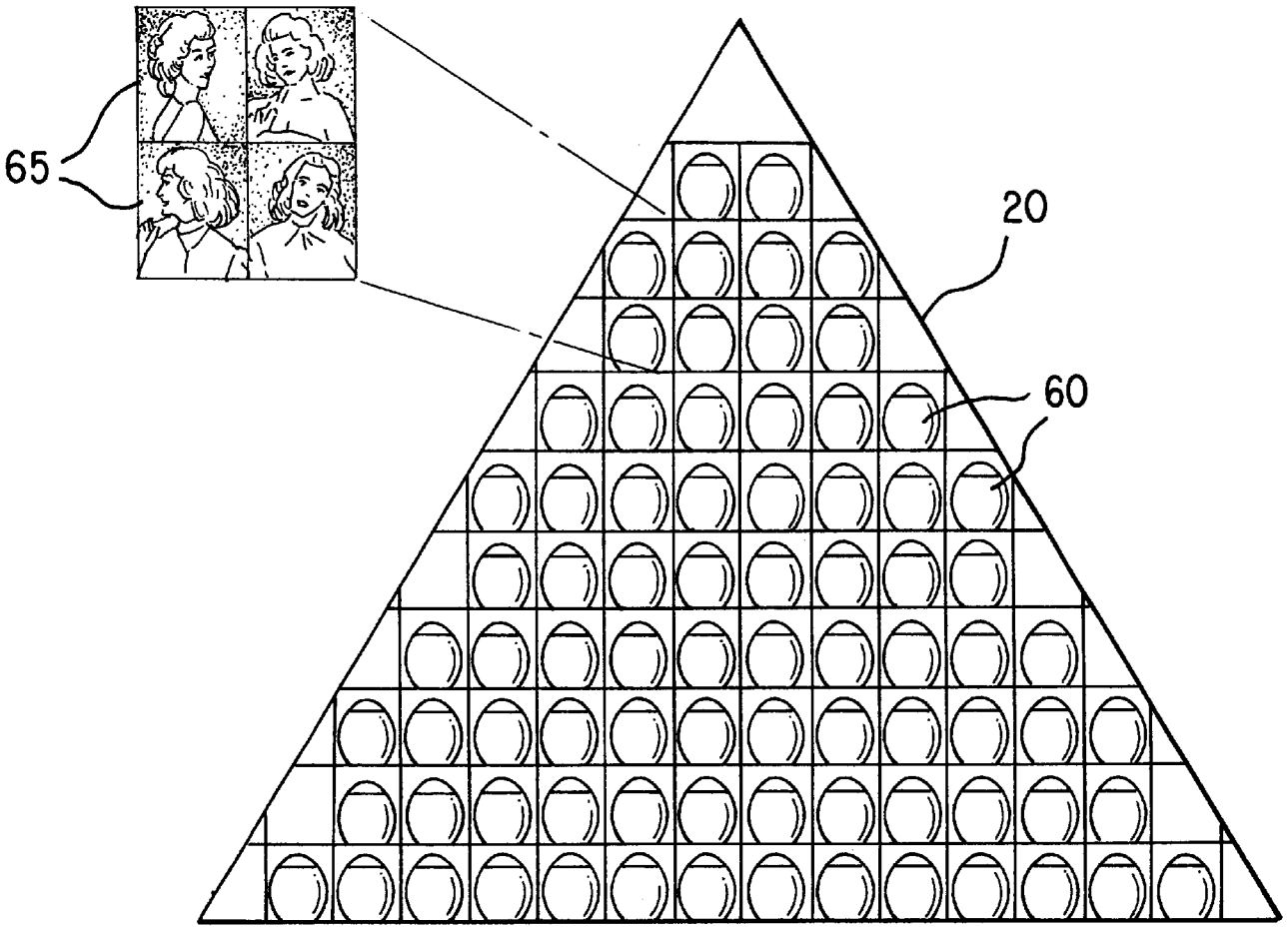
FIG. 6(*a*) is a front view of an embodiment of an interior wall of an inner pyramid-shaped structure in accordance with the present invention.
Figure 6B:
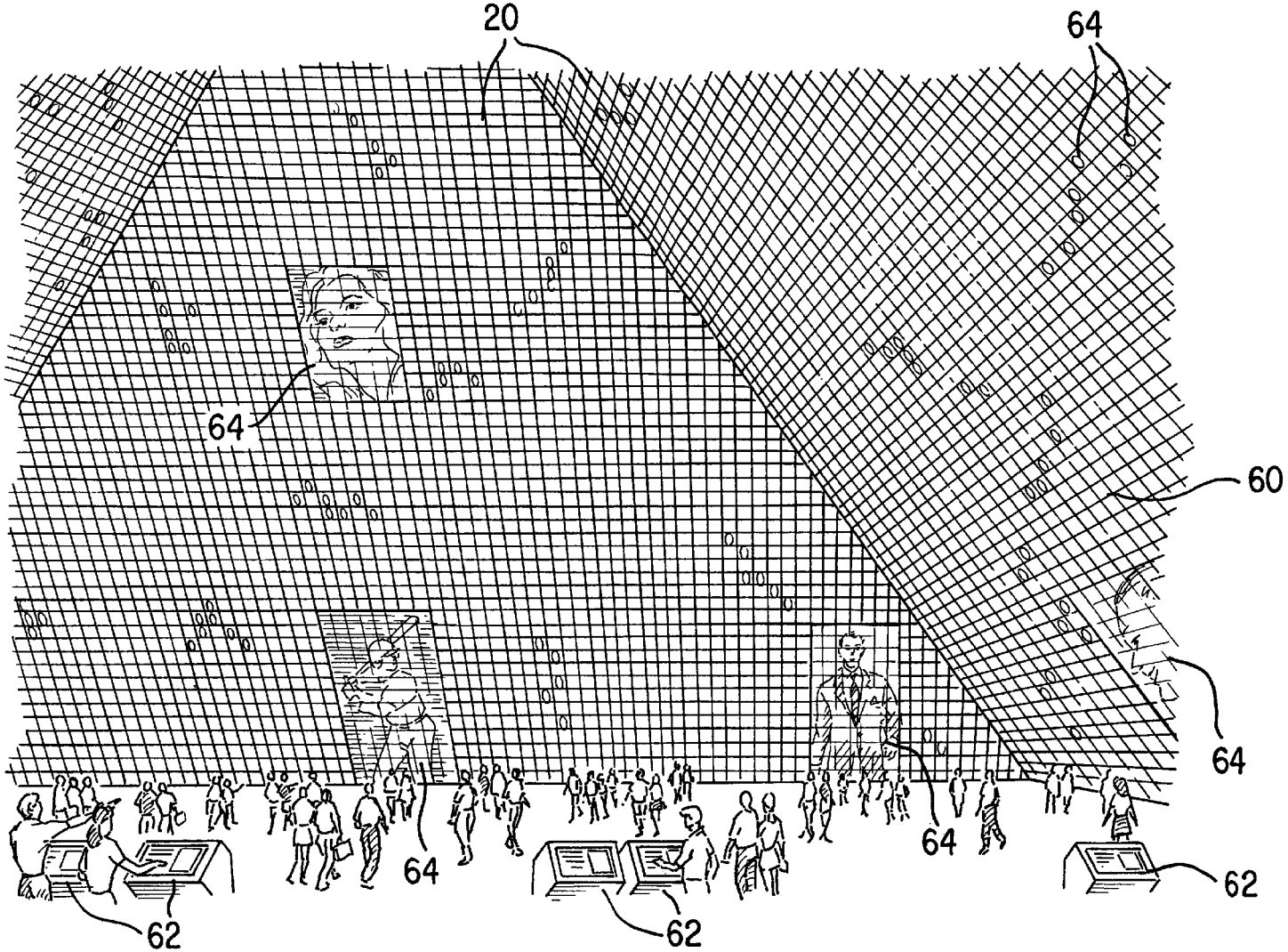

Preferably, at least one of the inner pyramid-shaped structures 20 will store urns 60. Thus, as shown in FIG. 6(*a*), at least one of the inner pyramid-shaped structures 20 may include storage niches for storing urns 60, wherein the storage niches are positioned within the inside walls of the inner pyramid-shaped structures 20. Transparent material, such as glass or plastic, embedded with holographic images 65 may cover the storage niches. Advantageously, each of the holographic images will be associated with the urn and thus the deceased whose urn 60 the image covers. For example, a holographic image of an old picture of the face of a deceased man may be positioned in front of the man's urn 60.

Referring to FIGS. 1, 2, and 4, preferably positioned underneath outer pyramid-shaped structure 10, is structure 30. Structure 30 is preferably a museum of different religions of the world. For example, the museum may include simulations or models of various well-known religious shrines and/or monuments, such as The Temple of Solomon, Christ's Tomb, The Temple on the Mount, and Buddhist, American Indian, Shinto and other religious shrines and memorabilia. Structure 30 may also include displays and exhibitions concerning religions throughout the world, and facilities for conducting and participating in religious ceremonies and services. These displays may be used for the actual performance of religious services or ceremonies or celebrations. In one implementation, structure 30 is a museum divided into two portions. One portion includes information and exhibits of western world religion and culture, such as that of Christianity and Judaism, and the Mayans, and the other portion includes information and exhibits of eastern religion and culture, such as that of Islam and Buddhism.

Vaults 40 and urns 60 may also be placed near or incorporated within the various religious exhibits, or in common areas beneath. Additionally, vaults 40 and urns 60 may be placed elsewhere, such as outside of outer pyramid-shaped structure 10.

Stairs are preferably included in the present invention and positioned on or within outer pyramid-shaped structure 10, inner pyramid-shaped structures 20, and world religions museum 30. Walkways are preferably also included. These walkways may be placed at or near the outer walls of inner pyramid-shaped structures 20, at different heights (along Y-axis; see FIG. 1), with protective walls or fences, and with lighting. Thus, visitors of the present invention may travel along the walkways to individual vaults in the embodiment where individual vaults are positioned at or near the external faces of the pyramid. The walkways may also or alternatively be positioned within outer pyramid-shaped structure 10, leading to hallways or rooms that lead to vaults or urns, or to utilities and/or sanitation facilities and otherwise as desired. The walkways may be constructed with various designs and sizes to compliment the present invention. In addition or instead of the stairs and/or walkways, the present invention may include trams, elevators, cable lifts, escalators, or combinations of those as desired.

Preferably, lighting is positioned for both practical and dramatic impact. Thus, at night, the lighting system may make the pyramid visible for miles, with the lighting system designed to produce a "heavenly glow," in certain atmospheric conditions. In one implementation of this embodiment, laser and floodlight elements will be positioned at the apex of outer pyramid-shaped structure 10, such that they will be able to illuminate various parts of the interior of inner pyramid-shaped structure 10. In another implementation or in addition, if the vaults 40 are positioned at the exterior of outer pyramid-shaped structure 10, anodized aluminum doors seal the vaults 40, and lights are positioned to reflect off the doors, creating a dispersed reflection and dramatic night view of the pyramid. This feature may be limited or altered as desired, and the lights may not produce a dramatic night view if the aluminum doors to the vaults are blocked by an opaque surface, such as where doors are positioned within outer pyramid-shaped structure 10, and outer pyramid-shaped structure is opaque.

Advantageously, solar panels are positioned on the exterior surface of outer pyramid-shaped structure 10 to generate the power for the lighting, and/or for the outer and inner-shaped pyramids and/or for the structure in its entirety.

Since the invention may be employed as a tourist attraction, other suitable fences, walls or security devices may be used to insure protection of the facility, and privacy for the customers. For example, separate access routes to various portions of the structures of the present invention may be employed for customers and tourists to promote customer privacy. If the cathedral 50 is employed in the present invention, as described above, certain sections of cathedral 50 may be sealed off so as to be inaccessible to tourists. Use of such measures will promote dignity and privacy, especially where employed to prohibit or control access by tourists to the vaults or urns, if desired.

Additionally, the present invention may include rooms or areas for funeral services 47, flower shops, crematory services, and gift or memorabilia shops. Rooms or areas such as shops 49, concessions, restaurants, and dining and entertainment areas may also be provided for food and beverage, sanitary needs, rest, and meditation as desired. Other areas or rooms positioned in or around the structures of the present invention may be employed for other activities as desired, including without limitation a visitor center 50, on-site sales 48, management, administration 46, and maintenance services 45.

Preferably, computer resources are included with the present invention. The computer resources may include terminals positioned inside outer pyramid-shaped structure 10 and also inside one or more inner-shaped pyramid structures 20 or within vaults 40 or crypts, accessible by patrons of the present invention. The computer resources may include a conventional computer system or network, as known in the art. Preferably, where the system or network is employed, the system or network is preferably accessible remotely via a public network, such as the Internet. In such a case, users of the present invention may employ the computer resources via the remote access. The present invention may be designed to limit the functions of the computer resources employable remotely, if desired.

The computer resources may be employed to store, retrieve and display records concerning specific individuals, such as records memorializing the humans or animals stored in the vaults or urns of the present invention. The memorial records may include video and photographic displays, such as home videos or family pictures of those whose urns or bodies are stored within or about inner or outer pyramid-shaped structures 10 or 20. The memorial records may also include other forms of information or artifacts that may help to describe or memorialize the diseased, such as artifacts and personal belongings, hair samples, and medical records, such as DNA. The memorial records that exist in tangible form, such as DNA, may have their images and/or other information associated with them stored within the computer resources. The tangible forms of those records may be stored within outer pyramid-shaped structure 10, such as within or near a specific urn or storage niche, if desired.

Storage of certain of the memorial records, such as the DNA, may be accomplished by refrigeration, freezing, such as cryogenic freezing, or other preservation techniques as known or as become known in the art. For example, the present invention may include a storage facility for DNA, which may be within or outside of outer pyramid-shaped structure 10. This storage facility may include space to store vials or other receptacles of DNA, and may store the DNA in cryogenic or other freezers for preservation. One example of a means for storing and preserving DNA is a structure designed by the company YouthCell. This structure is an environment-proof vault-like structure normally supplied with liquid nitrogen by a liquifaction facility on-site. The structure may be powered by solar radiation, and may use solar power, such as that generated by solar panels positioned on the outside of outer pyramid-shaped structure 10 or other structure. The DNA storage and preservation structure may have a back-up supply of liquid nitrogen contained in high-pressure storage tanks. Additional or alternative power sources for this structure are batteries and internal combustion driven generators that drive the liquifaction plant when liquid nitrogen reserves are exhausted. Advantageously, incorporation of means for storing DNA in the present invention will allow both visitors and clients of the present invention to conveniently extract and store DNA, so that a large number of DNA samples may be stored and potentially researched. As mentioned above, images of the DNA, such as on a microscopic scale, may be obtained, such as by photograph, and stored within the computer resources.

In a preferred embodiment, the present invention will enable living persons to store memorial records within or around outer pyramid-shaped structure 10 and also upload memorial records onto the computer resources, and to preserve and protect those records at the location (i.e. outer pyramid-shaped structure) where their remains or living cells may also ultimately be stored. By uniquely enabling the storage and retrieval of a comprehensive array of memorial records, the present invention will enable its users immediate and long term preservation and access to the memorial records, both during and after the life of the subject of the memorial records.

Preferably, users of the computer resources will load the memorial records into the computer resources from a remote site or from a terminal positioned inside outer pyramid-shaped structure 10. Preferably, the computer resources will be integrated with a projector of images, including those of lasers and other types of light, such that the computer resources will be employable to project stored videos and photographs, such as old videos or photographs of the deceased, onto walls or other surfaces of the building of the present invention, or on monitors or screens or other display media. For example, the computer resources may be employable within an inner pyramid-shaped structure 20 to project videos or other images such as genetic, DNA, or other informational displays onto an interior wall of an inner pyramid-shaped structure 20. Various known computerized devices such as imaging devices may be employed to project the images.

In one embodiment, the computer resources may be employed to display memorialization records and other images, such as those associated with the conducting of a funeral, memorial services, remembrances, or memorials or to project images of events that can be viewed in real-time from a remote site and that occur within or near the outer or one or more inner-shaped pyramids. In this embodiment, the memorialization records and other images, such as a funeral, will be recorded visually via a live video feed preferably viewable at a Web site created on the Internet for use with the present invention. Here, the computer resources are preferably connected to a server accessible from a remote site by communication via the Internet. Thus, those that are unable to travel to and attend a funeral at the location of the present invention may view the funeral in real time.

Additionally, the computer resources are preferably employable to control some of the lighting or the present invention. For example, where urns are covered by transparent materials embedded with holographic images, such as described above, the computer resources may be employable to illuminate the holograms and the urns positioned behind them, such as by controlled activation of laser beams. In an advantageous implementation of this example, the computer resources will be able to control the illumination such that specific holograms and urns may be separately illuminated. Thus, for example, as shown in FIG. 6(*b*), computer resources 62 may be employed within inner pyramid-shaped structure 20 to project light onto or to otherwise light specific urns 60 and their holographic images or to project images 64 onto the interior walls of pyramid-shaped structure 20, such as described above. The computer resources 62 may be configured as desired depending upon the design of the structure housing urns 60 or the wall or other surface onto which the images 64 will be projected. As mentioned above, computer resources 62 are preferably accessible remotely through the Internet or other public network to light specific urns 60 and their holographic images and/or to project images 64. The users preferably will be able to view lit urns 60 or projected images 64 on an Internet or other public network site, such as a web site.

Also, the computer resources may be employable to illuminate other portions inside outer pyramid-shaped structure 10 and/or inner pyramid-shaped structures 20, such as honorariums, plaques, or other structures installed as desired in the present invention for memorialization.

Figure 7:
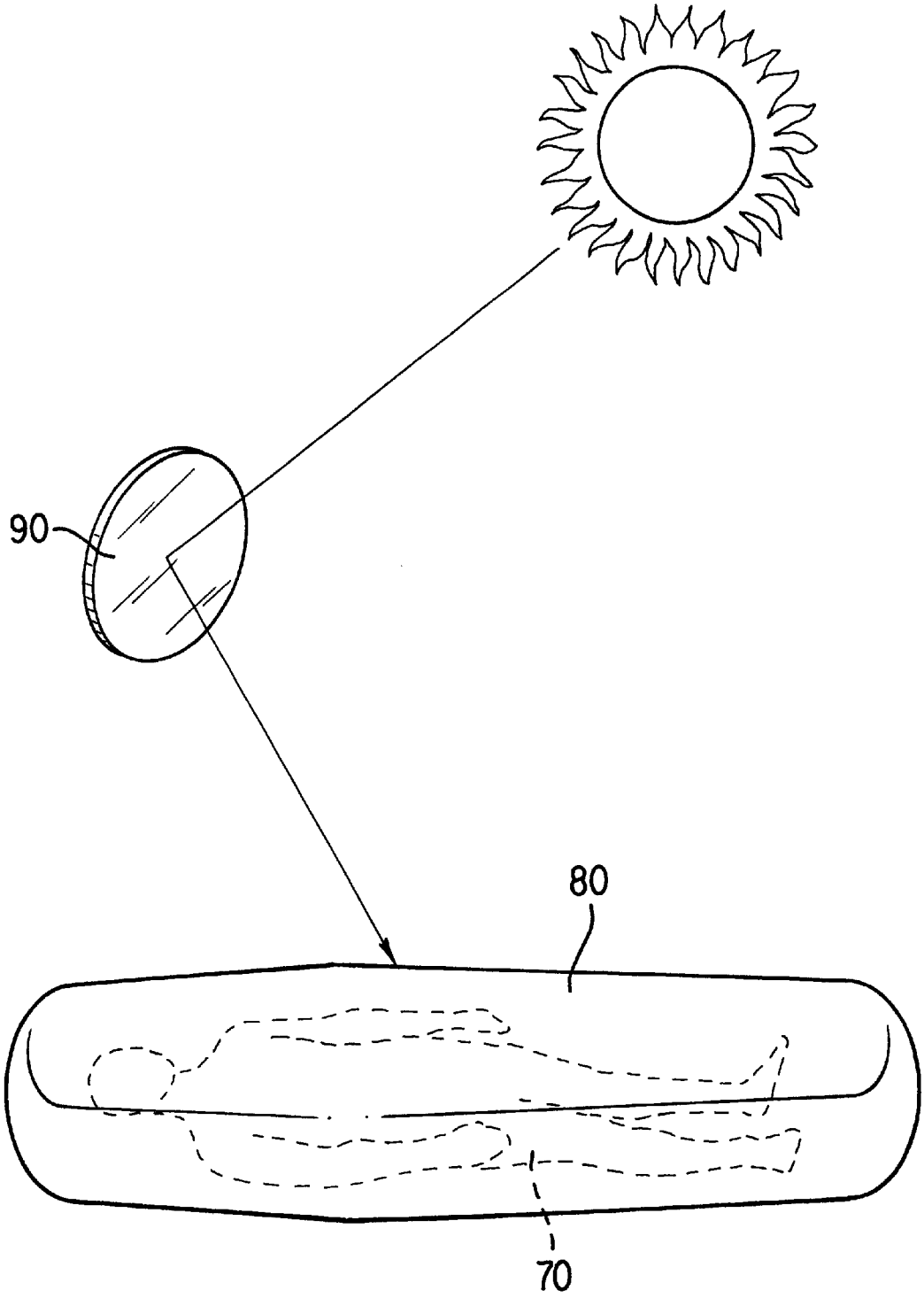
FIG. 7 is an example of a method for cremating remains that may be employed as part of the present invention.

A system may also be included to cremate human remains, preferably employing solar power for the cremation, although the system does not form an essential part of the present invention. For example, a crematorium, or structure built and configured for the cremation, may be included outside of outer pyramid-shaped structure 10, integrated within cathedral 50, or positioned elsewhere as desired. The cremation may be accomplished such as in FIG. 7, by placement of corpse 70 into capsule 80 or other compartment and elevation of capsule 80 into the proximity of parabolic mirror 90 positioned to receive sunlight and reflect it in concentrated form into the capsule. Solar panels positioned upon the exterior surfaces of outer pyramid-shaped structure 10 will create electricity to generate hydrogen gas, as known in the art. The hydrogen gas may then be pumped into the capsule and ignited by the reflected, concentrated sunlight, which will commence incineration of corpse 70. Advantageously, the capsule will be sealed to allow steam and carbon dioxide produced during the cremation of the body to help to produce a more inert atmosphere that will lower the rate of oxidation, improving the efficiency of the incineration of the body. Also, water produced during the cremation process may be removed by dessication accomplished by freeze-drying or, with hot dry air, a partial vacuum, and microwave heating. This process will dry the body, which will make it burn more quickly, cleanly, and with higher temperatures. Other preparatory steps that may be employed may include re-embalming the body, reducing the volume of water in the body to be cremated and replacing it with a more combustible liquid like alcohol, which may compensate somewhat for the lower temperatures caused by water vaporization, if dessication is impractical.

The crematorium may also employ an array of computer-controlled mirrors to focus the sun's rays into capsule 80. This system may be designed with tracking mirrors spread out over a large rectangular arc, which may span an acre such that the mirrors will focus sunlight towards the capsule. Such systems are employed in smelters and toxic waste incinerators, and similar systems are used to generate electricity.

The crematorium may also employ non-imaging condenser optics, such as those applied to solar energy heating and power systems, in a focused solar-tracking array, as known in the art. This system would concentrate the sunlight collected from above the chamber into capsule 80.

The crematorium may alternatively employ an array of high-power lasers as an alternative to solar power for incineration and to drive combustion of the gas pumped into capsule 80. Alternatively, an array of quartz-arc lamps may be employed to provide enough heat, if efficiently collected and focused, to combust the gas in capsule 80. Alternatively, high-voltage plasma arcs may be employed in a nearly evacuated chamber to create energy for combustion. Alternatively, a system similar to the gas-mantel lantern may be employed to burn the fuel at the surface of a mesh screen resulting in intense light appearing to envelope, but actually incinerating, the body. This approach can be fueled by gas, but may also be adapted to other fuels. Also, natural gas may be employed at high temperatures for the burning process.

Additionally, other technologies employing energies such as intense ultraviolet light, radiowaves, or ultrasonics may be employed with the crematorium, as well as other combustion and incineration methods known in the art. Note that the above-described embodiments for cremating remains, as appropriate, may employ gases other than hydrogen, such as peroxide and alcohol, or liquid oxygen.

The above embodiments for cremating remains will preferably also employ technology to reduce exhaust emissions caused by the combustion and incineration. For example, fueled afterburners and catalytic converters may be employed. Precipitators and scrubbers may be employed to limit the emission of ash, smoke, and odors.

In addition to the embodiments and examples of the present invention described above, the invention may also include other religious and scientific displays, sound and light shows, theatrical performances, concerts, and other media displays within and outside of outer pyramid-shaped structure 10.

While the foregoing description and drawings represent the preferred embodiments of the present invention, it will be understood that various additions, modifications, and substitutions may be made without departing from the spirit and scope of the present invention as defined in the accompanying claims. In particular, it will be clear to those skilled in the art that the present invention may be embodied in other specific methods, forms, structures, arrangements, proportions, and with other elements, materials, and components, without departing from the spirit or essential characteristics of the invention. Thus, the above descriptions of the arrangement and interrelationship of the elements comprising the invention are not proscriptive, in that various substitutions of building or structure shapes or forms, and arrangements of different elements may accomplish the same overall objective; namely the integration of religion and exhibits displaying human myths and science in a uniquely-configured structure enabling the mass memorialization of the living and dead to people of all backgrounds and ages. It will also be appreciated that features described with respect to one embodiment typically may be applied to another embodiment, whether or not explicitly indicated. The various features described may be used singly or in any combination. The presently disclosed embodiments are therefore to be considered in all respects as illustrative and not restrictive, the scope of the invention being indicated by the appended claims, and not limited to the foregoing description.

What is claimed is:

1. A building for storing human and animal remains, comprising:

an outer pyramid-shaped structure;

one or more inner pyramid-shaped structures housed within the outer pyramid-shaped structure;

at least one of said inner pyramid-shaped structures configured and adapted to permit entry of visitors within said at least one inner pyramid-shaped structure;

and vaults and urns for storing the human remains, wherein the urns are positioned in storage niches housed within the outer pyramid-shaped structure.

2. The building of claim 1, further comprising multiple inner pyramid-shaped constructions, wherein one or more of the multiple inner pyramid-shaped structures intersect one or more of the multiple inner pyramid-shaped structures.

3. The building of claim 1, further comprising a structure positioned beneath the outer pyramid-shaped structure for providing information and services concerning different world religions.

4. The building of claim 3, further comprising additional vaults and storage niches housed within the structure positioned beneath the outer pyramid-shaped structure.

5. The building of claim 1, further comprising additional vaults positioned underneath the outer pyramid-shaped structure.

6. The building of claim 1, further comprising computer resources accessible from within the building, enabling the retrieval of memorial records concerning individuals or animals.

7. The building of claim 6, wherein the computer resources are employable to control lighting within the outer pyramid-shaped structure.

8. The building of claim 1, further comprising religious structures positioned at the top of the outer pyramid-shaped structure.

9. The building of claim 8, wherein the religious structures comprise a cathedral.

10. The building of claim 8, comprising solar panels positioned in proximity to the building to create power for use by the computer resources.

11. The building of claim 1, wherein the vaults are positioned on external faces of the outer pyramid-shaped structure.

12. The building of claim 1, further comprising solar panels positioned on an exterior surface of the outer pyramid-shaped structure to create power for use by the building.

13. The building of claim 1, wherein the inner pyramid-shaped structures have inside walls, and storage niches are positioned behind the surfaces of the inside walls.

14. The building of claim 13, wherein holographic images are embedded in transparent material covering the storage niches.

15. The building of claim 14, wherein each holographic image embedded in the transparent material is associated with the urn positioned in the storage niche behind the transparent material.

16. The building of claim 14, further comprising computer resources that enable specific storage niches to be lit.

17. A building for storing human and animal remains, comprising:

an outer pyramid-shaped structure;

one or more inner pyramid-shaped structures housed within the outer pyramid-shaped structure;

computer resources accessible from within the one or more inner pyramid-shaped structure, enabling the retrieval of memorial records concerning individuals or animals;

and vaults and urns for storing the human remains, wherein the urns are positioned in storage niches housed within the outer pyramid-shaped structure.

* * * * *

UNITED STATES PATENT AND TRADEMARK OFFICE

CERTIFICATE OF CORRECTION

PATENT NO. : 6,681,534 B2
DATED : January 27, 2004
INVENTOR(S) : Friedland et al.

It is certified that error appears in the above-identified patent and that said Letters Patent is hereby corrected as shown below:

Title page,
Item [12], please change "David et al." to -- Friedland et al. --
Item [75], Inventors, "Friedland David" should read -- David Friedland. --

Figure 8:
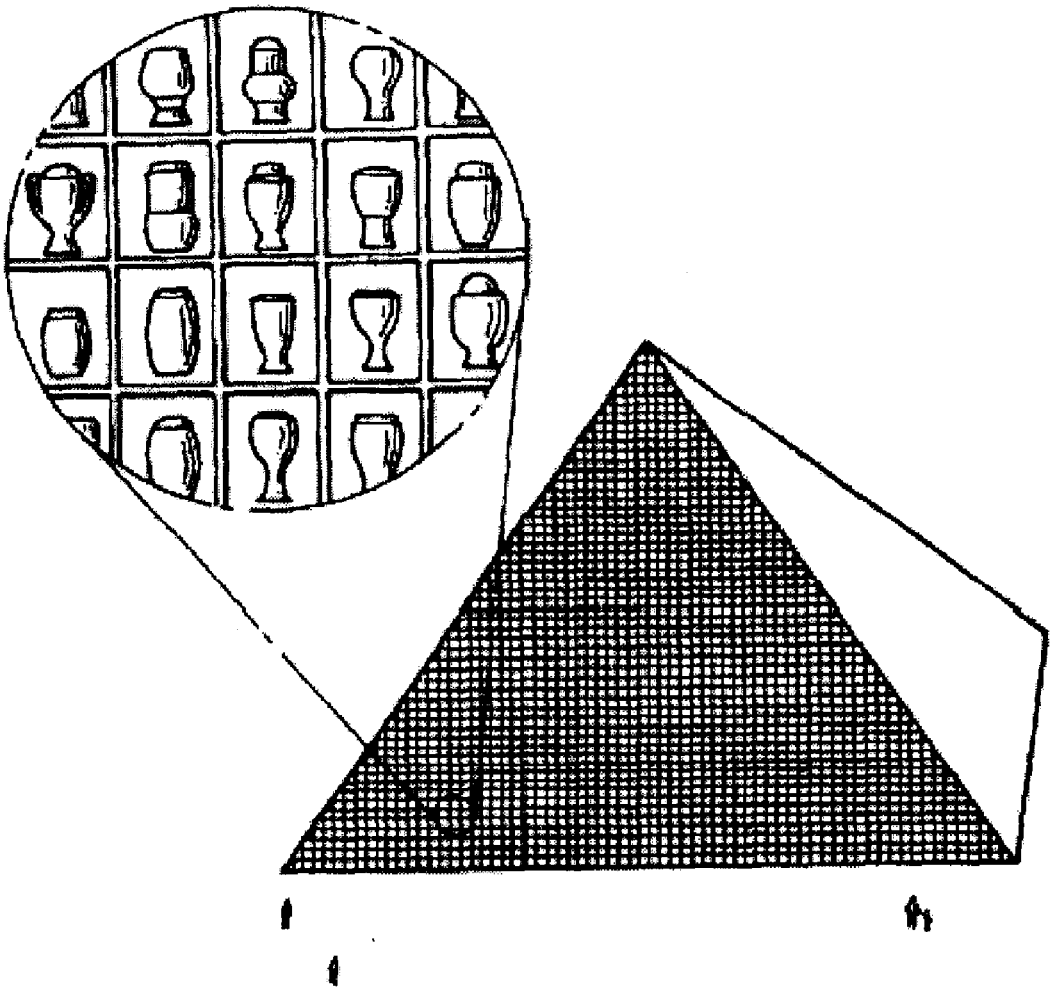

Drawings,
Figure 8, attached, should be included with the patent.

Column 4,
After line 56, please insert -- Fig. 8 is a front view of an embodiment of the outer pyramid-shaped structure showing urns positioned in the outer wall. --

Signed and Sealed this

Tenth Day of August, 2004

JON W. DUDAS
*Acting Director of the United States Patent and Trademark Office*